US005766025A

United States Patent [19]

Davis

[11] Patent Number: 5,766,025

[45] Date of Patent: Jun. 16, 1998

[54] ELECTRICAL CONNECTOR

[75] Inventor: Wayne S. Davis, Harrisburg, Pa.

[73] Assignee: The Whitaker Corporation, Wilmington, Del.

[21] Appl. No.: 848,709

[22] Filed: May 1, 1997

Related U.S. Application Data

[63] Continuation of Ser. No. 411,137, Mar. 27, 1995, abandoned.

[51] Int. Cl.[6] ..... H01R 23/00

[52] U.S. Cl. ..... 439/660; 439/676; 439/746

[58] Field of Search ..... 439/607–610, 439/660, 676, 843, 751, 108, 637, 746

[56] References Cited

U.S. PATENT DOCUMENTS

| | | | |
|---|---|---|---|
| 3,582,863 | 6/1971 | Hoffman . | |
| 4,124,264 | 11/1978 | Kato et al. . | |
| 4,682,836 | 7/1987 | Nooriley et al. | 439/607 |
| 4,685,758 | 8/1987 | Yoshida | 439/607 |
| 4,740,177 | 4/1988 | Heimbrock | 439/596 |
| 5,017,156 | 5/1991 | Sugiyama | 439/607 |
| 5,073,130 | 12/1991 | Nakamura | 439/607 |
| 5,266,038 | 11/1993 | Nakamura | 439/79 |
| 5,267,882 | 12/1993 | Davis | 439/610 |
| 5,295,843 | 3/1994 | Davis et al. | 439/108 |
| 5,378,170 | 1/1995 | Abe et al. | 439/595 |
| 5,456,618 | 10/1995 | Nakamura | 439/607 |

FOREIGN PATENT DOCUMENTS 900332 7/1962 United Kingdom .

OTHER PUBLICATIONS

Search Report dated Jun. 27, 1996, corresponding European patent application EP 96 30 1067 (two pages).

U.S. Patent application Ser. No. 08/014,911 filed Feb. 8, 1993 (Abstract and Drawings only included).

*Primary Examiner*—Neil Abrams
*Assistant Examiner*—Brian J. Biggi
*Attorney, Agent, or Firm*—Anton P. Ness

[57] ABSTRACT

An electrical connector (1) comprising: multiple electrical contacts (4) within corresponding contact receiving cavities (3), each corresponding cavity (3) being in a housing (2), overhangs (7) along lateral walls (8) of each cavity (3), each contact (4) comprising an elongated contact section (11) having been formed with an arch (13) and lateral sides (12, 12) along each corresponding contact (4) being confined by the overhangs (7), and the arch (13) projecting between said overhangs (7) for mating engagement with a contact of another mating electrical connector.

9 Claims, 6 Drawing Sheets

ELECTRICAL CONNECTOR

This application is a Continuation of Application Ser. No. 08/411,137 filed Mar. 27, 1995, now abandoned.

FIELD OF THE INVENTION

The invention relates to an electrical connector, and more particularly, to an electrical connector having thin blade contacts of exceptional strength and retention in a housing.

BACKGROUND OF THE INVENTION

An electrical connector according to U.S. Pat. No. 5,017,156 discloses thin and horizontal portions of electrical contacts supported along their entire flat lengths by respective stepped grooves in an insulating housing. Accordingly, the horizontal portions are adapted to sufficiently stand the contact pressures generated when coming into contact with the contacts of another mating electrical connector.

SUMMARY OF THE INVENTION

A feature of the invention resides in an electrical contact having an arch shape for strength.

Another feature of the invention resides in an insulating housing, a contact receiving cavity in the housing, the cavity having overhangs that confine lateral edges of an electrical contact in the cavity.

According to the invention, an electrical connector comprises, an insulating housing, contact receiving cavities and multiple electrical contacts in corresponding cavities, overhangs along lateral walls of each corresponding cavity, each contact being constructed with lateral sides confined by the overhangs, and each contact being constructed with an arch extending from one lateral side to the other lateral side, an elongated apex of each arch projecting between the overhangs on a corresponding cavity, and each apex providing a contact surface for mating engagement with another mating electrical connector.

DESCRIPTION OF THE DRAWINGS

An embodiment will now be described with reference by way of example to the accompanying drawings, according to which.

DETAILED DESCRIPTION

Figure 1:
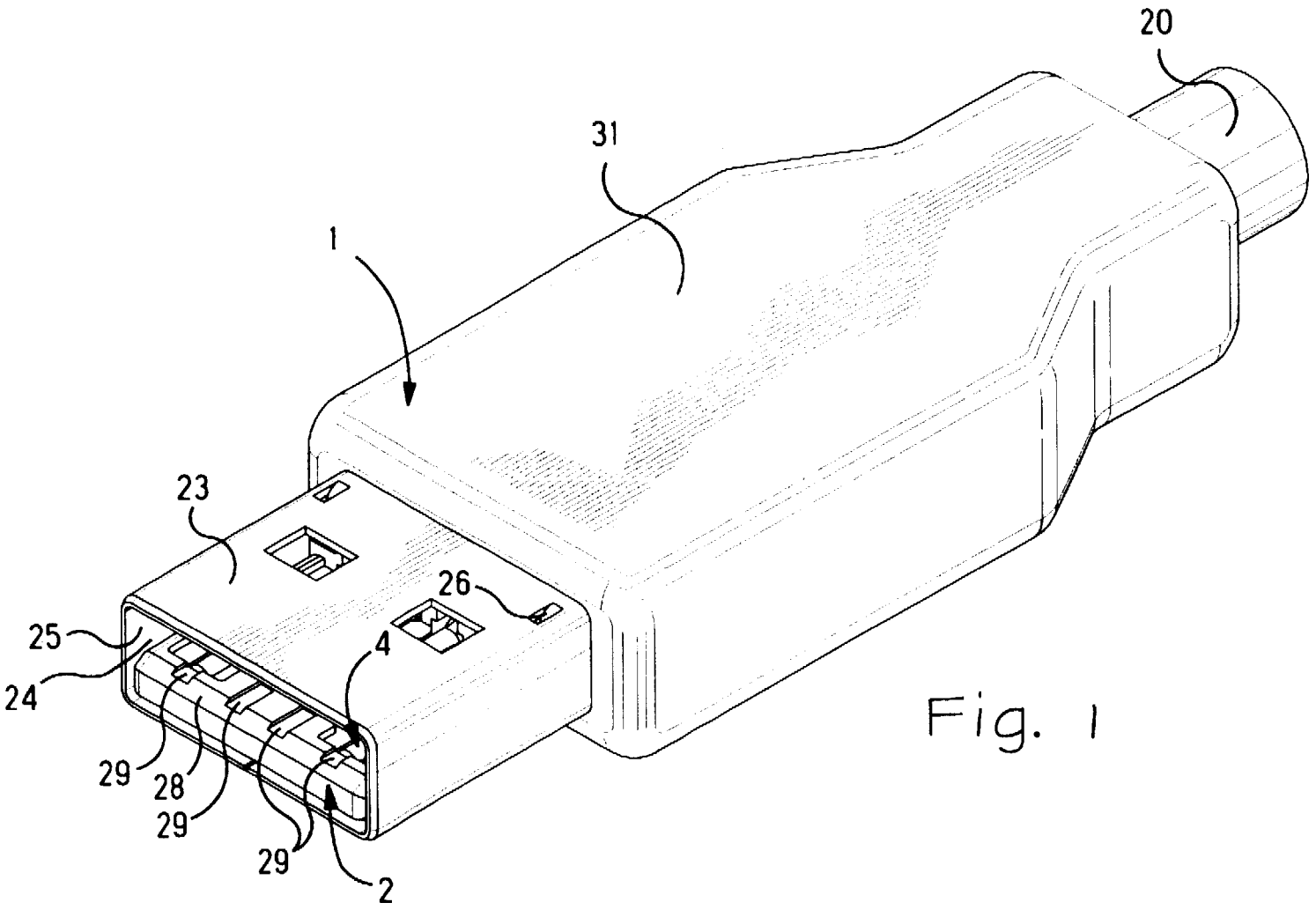
FIG. 1 is an isometric view of an electrical connector including a housing and shield assembly terminated to an electrical cable.
Figure 2:
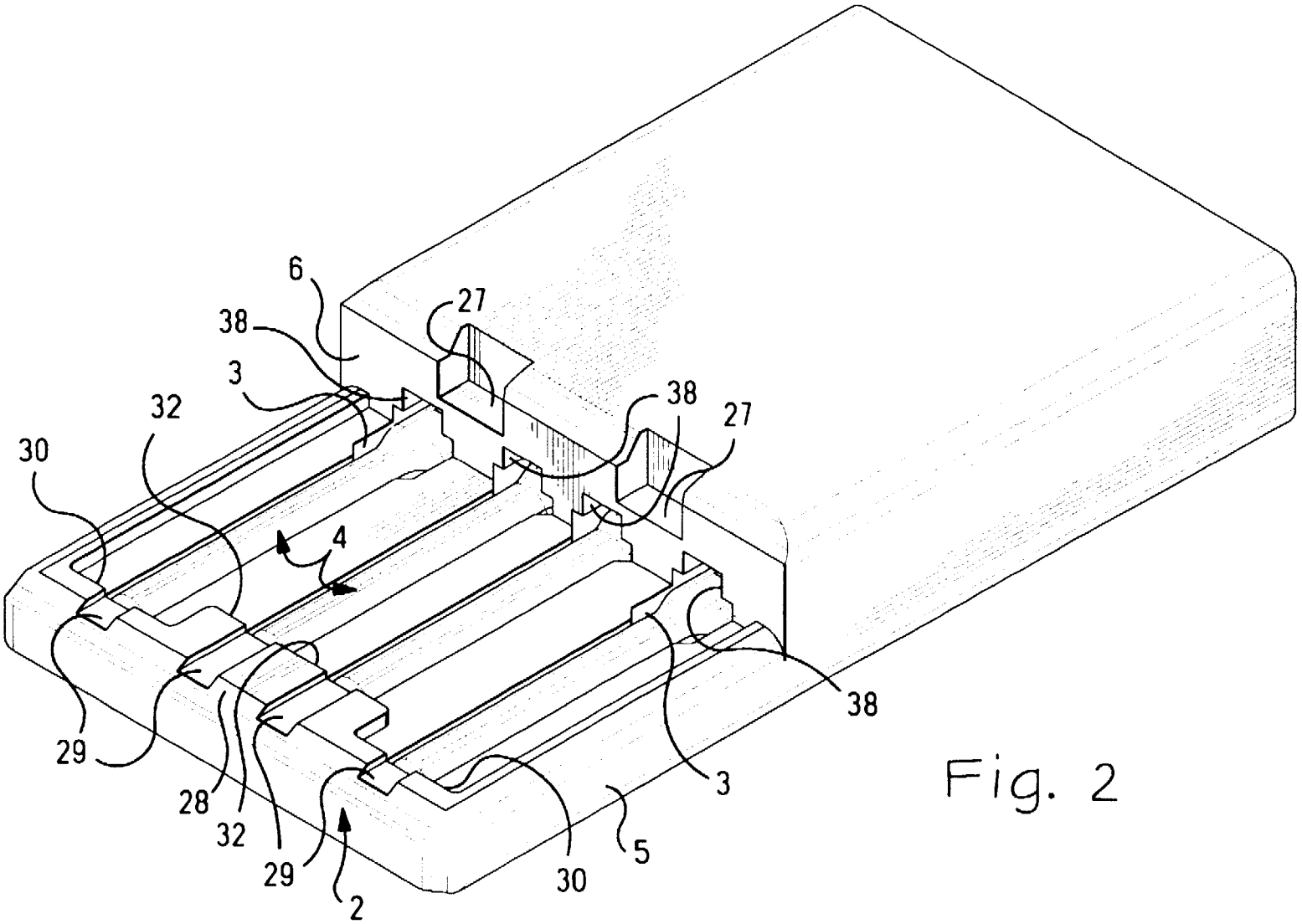
FIG. 2 is an isometric view of an insulating housing of the connector shown in FIG. 1 with contacts disposed therein.
Figure 3:
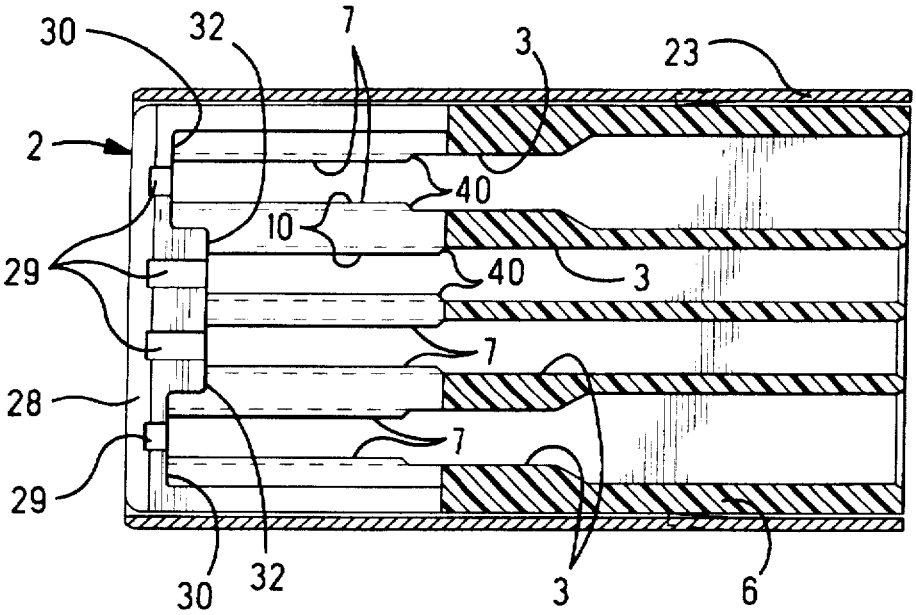
FIG. 3 is a plan section view of the housing shown in FIG. 2, together with a conductive shield of the connector shown in FIG. 1.

In FIGS. 1 and 2, an electrical connector 1 terminating a cable 20 comprises an insulating housing 2 having contact receiving cavities 3 therethrough and multiple electrical contacts 4 in corresponding cavities 3. Housing 2 is, for example, of unitary molded plastic construction, and comprises a front section 5 and a rear section 6. A conductive shield 23 encircles the housing 2, and an insulative body 31 is molded around rearward portions of the connector and an adjacent portion of cable 20.

Figure 10:
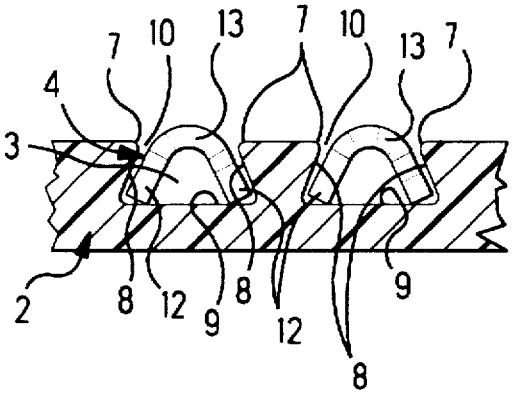
FIG. 10 is a cross-sectional view facing rearwardly of a front portion of the housing and two electrical contacts of the connector as shown in FIG. 1.

In FIG. 10 are seen overhangs 7 that extend along lateral walls 8 of each cavity 3, and each cavity 3 is dovetail in cross section. The overhangs 7 on each cavity 3 comprise lateral walls 8 beginning at a wider bottom 9 of the cavity 3 and inclining toward each other to a narrower elongated opening 10 between the overhangs 7.

With reference to FIGS. 6–10, each corresponding contact 4 is constructed, for example, of a stamped and formed unitary thin metal blank. A front section 11 of the contact 4 is of thin blade construction, and has elongated lateral sides 12 confined by the overhangs 7 in the corresponding cavities 3. Each contact 4 is constructed with an arch 13 extending from one lateral side 12 to the other lateral side 12. The arch 13 strengthens the otherwise weak and thin blade shape, and further permits divergence of lateral sides 12 that can be confined under the corresponding overhangs 7. An elongated apex of each arch 13 projects in the opening 10 between the overhangs 7 on a corresponding cavity 3. Each apex projects outwardly above the overhangs 7, and provides a smooth, elongated, wiping contact surface. Each apex provides a wiping contact surface for mating engagement with another mating electrical connector, not shown. A front edge 14, FIG. 6, on the apex of the arch 13 is beveled to slope from rear to front where the apex projects outwardly of the corresponding contact receiving cavity 3. The beveled front edge 14 prevents stubbing of the contact 4 against another mating electrical contact during mating connection of the connector with another mating electrical connector, not shown. Rear section 15 of contact 4 comprises a first connection being a crimp barrel 16 formed by a first pair of wings 17 initially defining an open barrel for receipt of a conductor portion 18 of an insulated wire 19 of an electrical cable 20, FIG. 1, for crimping thereto to form a crimp connection. A second connection is a second crimp barrel 21 formed by a second pair of wings 22 initially defining an open barrel for receipt of an insulated portion of the insulated wire to form a strain relief. It is seen that outer ones of contacts 4 are provided with larger rear sections 15 corresponding to larger diameter wires such as are used for power transmission, while inner ones are associated with smaller diameter wires for signal transmission.

With reference to FIGS. 2–5, each corresponding contact receiving cavity 3 widens toward the rear section 6 to receive different sizes of the rear sections 15 of the contacts 4. The rear sections 15 may vary in size and material mass to conduct different amounts of electrical energy without excessive resistance to conduction. For example, a larger size and mass will provide less resistance to conduction of electrical energy than a smaller size and mass. A contact 4 of smaller size is less costly, and allows closer spacing of the cavities 3 in the housing 2, and requires less insulation surrounding the contact 4.

The overhangs 7 extend lengthwise an equal length along the respective contact receiving cavities 3. The elongated contact sections 11 of the contacts 4 of smaller size are identically formed, with arch 13 of each of the contact sections 11 extending from one lateral side 12 along the elongated contact section 11 to another lateral side 12, to be mounted interchangeably in any of the contact receiving cavities 3.

Figure 11:
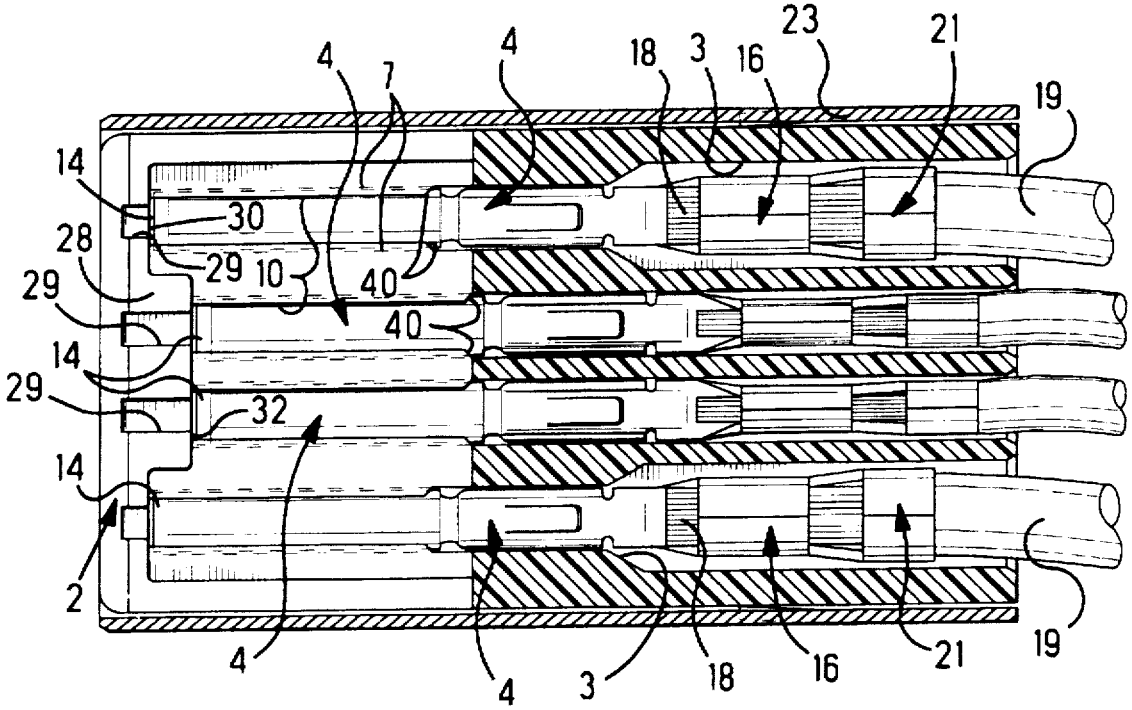
FIGS. 11 and 12 are section views of the housing and shield assembly of the connector of FIG. 1 illustrating contacts in the cavities.
Figure 12:
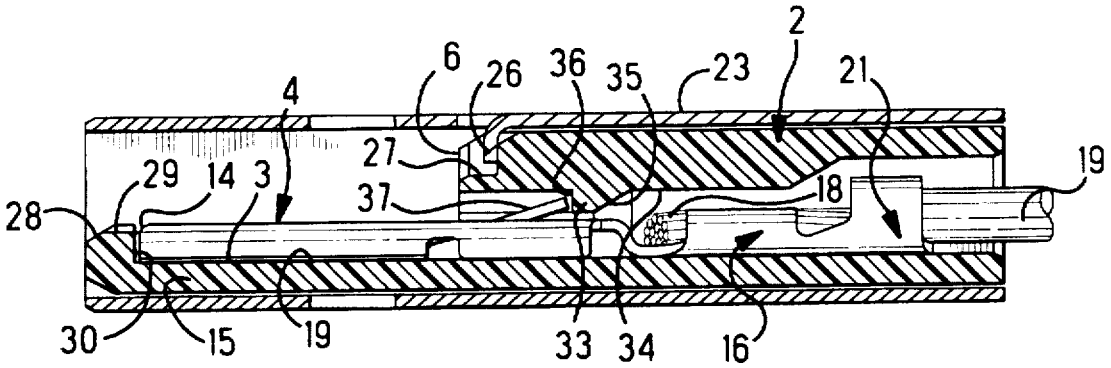

With reference to FIGS. 1, 11 and 12, a conductive shield 23 encircles the housing 2. A passage 24 has an opening 25 at a front end of the shield 23. The passage 24 extends along an interior of the shield 23 from the front of the housing 2 to its rear end, and the interior surface of shield 23 is spaced away from the apex of each contact 4. A tab 26, FIG. 12, projecting from the shield 23 is bent downward and extends into a tab receiving recess 27 forwardly of rear housing section 6 to resist movement of the housing 2 forwardly with respect to the shield 23. The recess 27 extends from an outer periphery of the housing 2 that is against the shield 23.

With reference to FIGS. 2, 11 and 12, an inclined front lip 28 on the housing 2 projects in front of each cavity 3 and in front of a contact 4 in each cavity 3. The inclined front lip 28 provides a funnel that biases mating electrical contacts, not shown, into the passage 24 for wiping engagement with each corresponding apex of the corresponding ones of the contacts 4. Each cavity 3 communicates with a groove 29 in the front lip 28. Each groove 29 is aligned with the apex of a corresponding contact 4 in the corresponding cavity 3. When the lip 28 bears against mating electrical contacts, not shown, the lip 28 wipes insulation material against the mating electrical contacts. It is desired to prevent wiping of the mating contacts against insulation material of the lip 28, particularly at the same place where the contacts 4 engage the mating contacts. Such wiping against the insulative material would tend to apply insulative material on the mating contacts and would be between the contacts 4 and the mating contacts. The presence of the applied insulative material where the contact 4 and the mating contacts engage one another during mating would reduce electrical conductivity undesirably. Accordingly, the grooves 29 allow unwiped portions of the mating electrical contacts 4 to traverse along the grooves 29 prior to connection to respective apices of the contacts 4. Further details are described in Ser. No. 08/014,911, filed Feb. 8, 1993.

First front walls 30 of selected ones of the corresponding contact receiving cavities 3 (FIG. 5) are positioned farther forwardly than second front walls 32 of the selected other ones of the corresponding contact receiving cavities 3, so that the selected ones of the contact receiving cavities 3 begin farther forwardly than the selected other ones of the contact receiving cavities 3. The contacts 4 in the cavities 3 advantageously mate in sequence with mating contacts of a mating electrical connector, not shown, depending upon their respective spacings in the cavities 3 from the front end of the housing 2.

Figure 4:
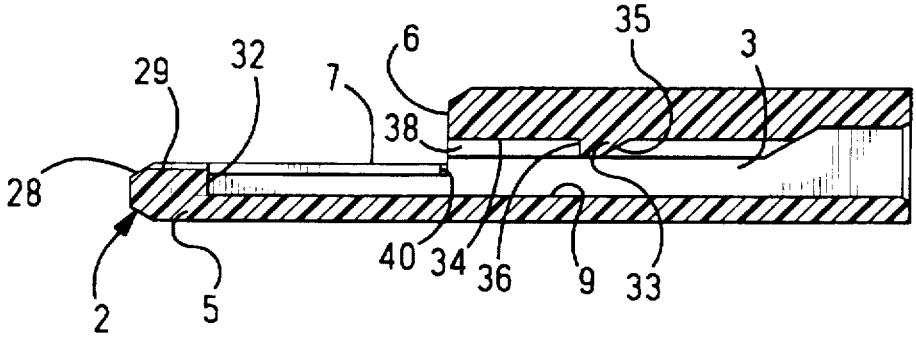
FIGS. 4 and 5 are longitudinal section views taken through a portion of the housing as shown in FIG. 2.
Figure 5:
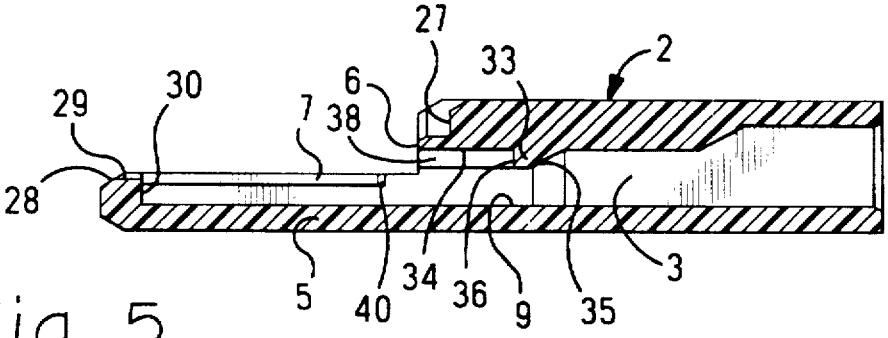
Figure 6:
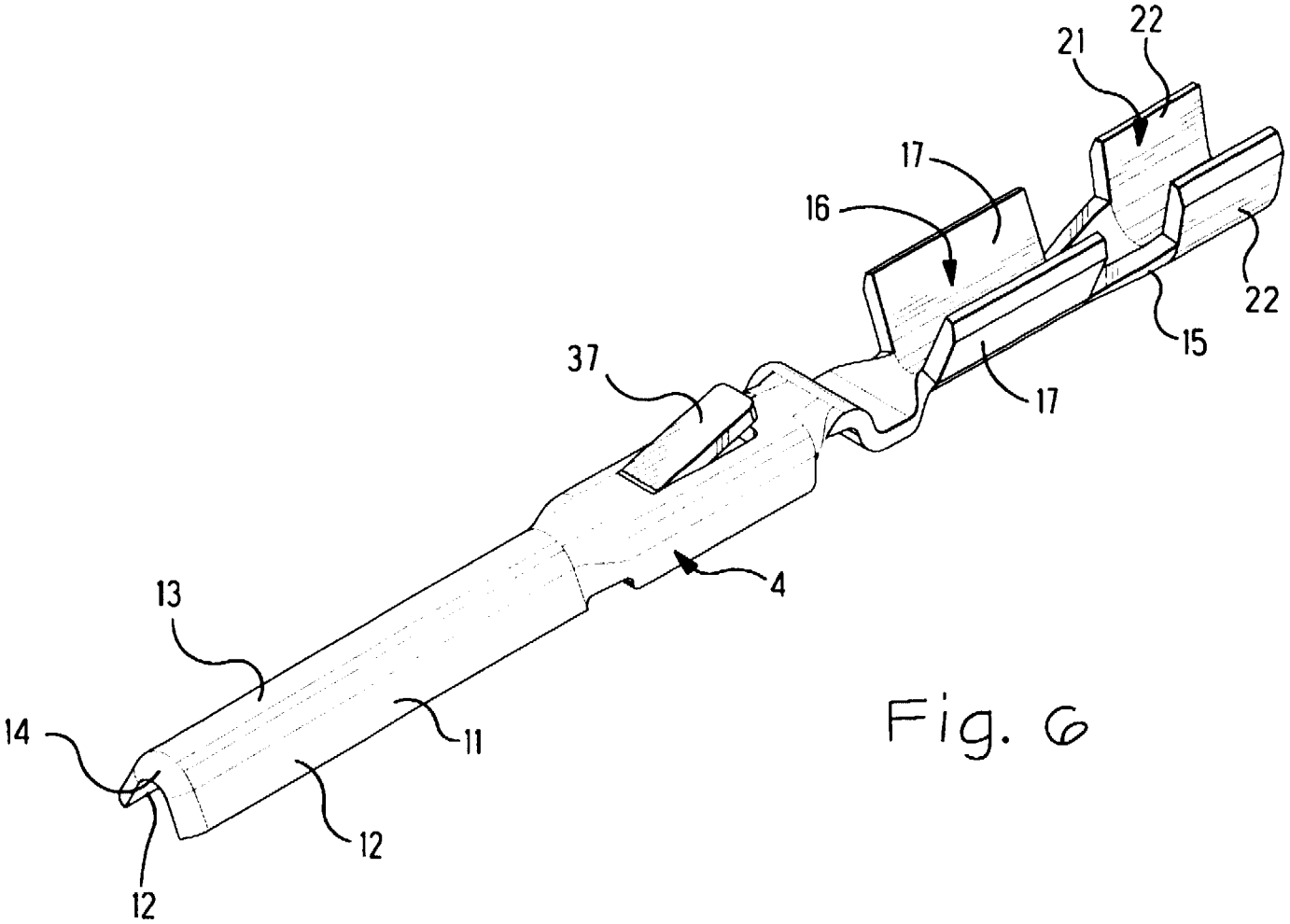
FIG. 6 is an isometric view of an electrical contact of the connector.
Figure 7:
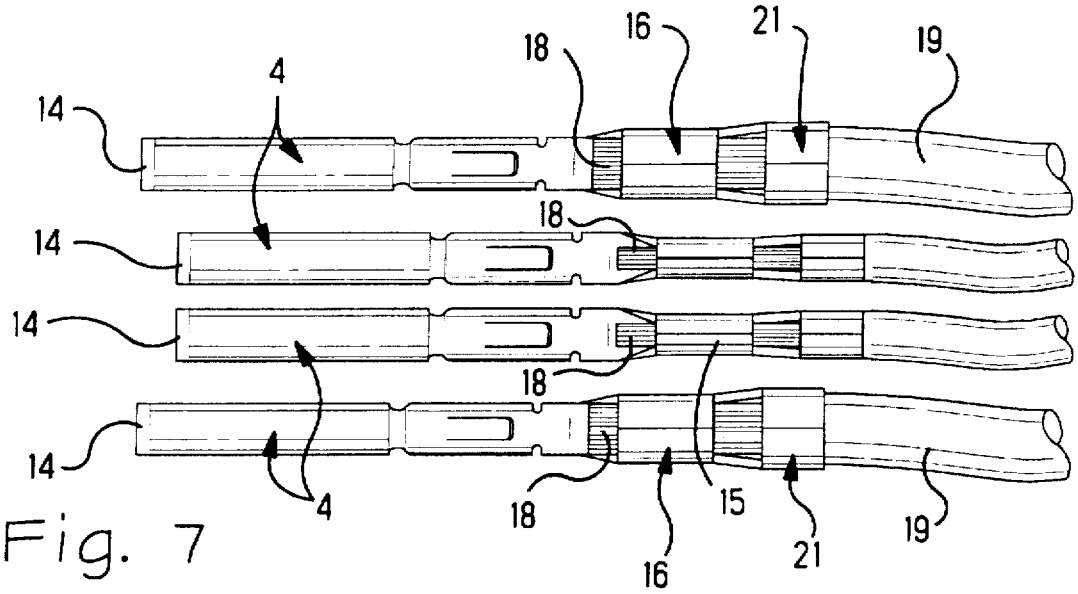
FIG. 7 is a top view of four electrical contacts terminated to conductor wires.
Figure 8:
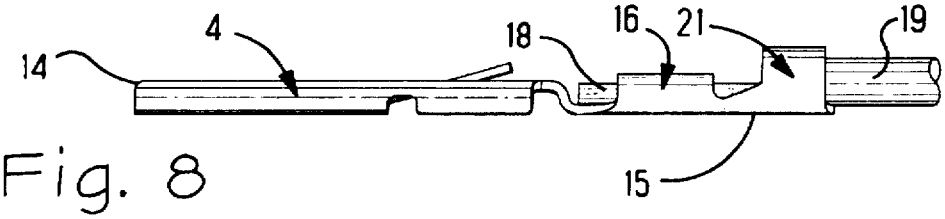
FIGS. 8 and 9 are side views of respective ones of the electrical contacts as shown in FIG. 7.
Figure 9:
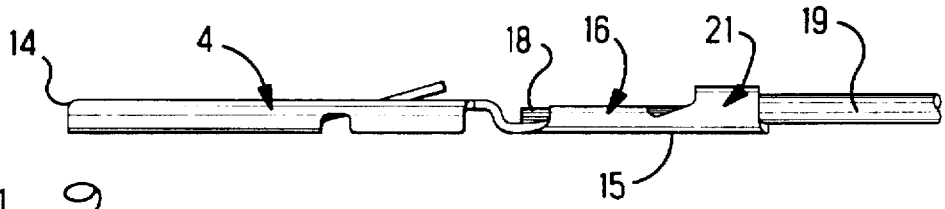

With reference to FIGS. 4, 5 and 12, a projection 33 is on a corresponding interior wall 34 in each contact receiving cavity 3. An internal sloped wall 35 is on a rear of each projection 33 to bias a corresponding front edge 14 on a corresponding contact 4. A front facing shoulder 36 is on each projection 33 and each contact 4 has a rear projecting, resilient tine 37 facing a corresponding front facing shoulder 36. The tine 37 is resiliently deflectable to pass beyond the projection 33 as the contact 4 moves along its corresponding cavity 3 to abut front wall 30 or 32. The tine 37 springs outward and faces the shoulder 36 to resist movement of each corresponding contact 4 rearward relative to the housing 2 after full insertion. Aligned and in front of the projection, 33, a narrow channel 38 communicates with a front face of the rear housing section 6 and its sidewalls are only sufficiently wide apart as to provide lateral support on opposite sides of the tine 37 to resist rotation of the contact 4 along its lengthwise axis.

To facilitate contact insertion, the sloped wall 35 on each contact receiving cavity 3 is sloped from rear to front, and faces the interior bottom wall 9 of the cavity 3 as do other wall portions of cavity 3 at reductions in dimensions from rear to front therealong. The interior bottom wall 9 in each cavity 3 opposes both the internal sloped wall 35 and the overhangs 7. A corresponding contact 4 is inserted into the cavity 3 from the rear section 9. The contact 4 traverses along the cavity 3. The lateral edges 12 on the contact 4 must traverse against the bottom wall 9 for correct alignment along the cavity 3 in both the rear section 6 and the front section 5 of the housing 2. The bottom wall 9 guides the lateral edges 12 on the contact 4 under the corresponding overhangs 7. The sloped wall 35 and the bottom wall 9 bias opposite sides of the contact 4 toward the front section of the corresponding cavity 3. The sloped wall 35 being opposite the apex 13 of a corresponding contact 4 biases the beveled front edge 14 on the apex 13 to pass beneath rear ends 40 on the overhangs 17. The rear ends 40 are tapered from rear to front and funnel the contact 4 into axial alignment with the front section of the corresponding cavity 3.

An advantage of the invention resides in an electrical connector comprising, contact receiving cavities in an insulating housing, and overhangs along edges of the cavities to resist movement of electrical contacts confined beneath the overhangs.

Another advantage of the invention resides in an electrical connector comprising, electrical contacts with thin blades and an arch on each thin blade that strengthens the contact and provides a contact wiping surface.

What is claimed is:

1. An electrical connector comprising:

a housing having a connector receiving recess at a mating face thereof, and containing multiple electrical contacts each within a corresponding contact receiving cavity of said housing, a portion of each corresponding said cavity extending along said connector receiving recess, and each said contact comprising an elongated contact section disposed in said cavity portion and exposed to said connector receiving recess, each said contact section defining a U-shaped cross-section extending to a forward end thereof, with side walls of said U-shaped contact section diverging to lateral edges thereof and forming an arch extending from one side wall to another side wall along said elongated contact section, side walls of each said cavity portion converging from a wide cavity bottom to a narrow opening and forming a dovetail cross-section complementary to said U-shaped cross-section of said contact section so that said side walls of said contact section extend therealong and therebeneath and are assuredly confined therein, and an elongated apex of said arch projecting outwardly from said narrow opening into said connector receiving recess to provide an elongated contact surface for mating engagement with a contact of another mating electrical connector.

2. An electrical connector as set forth in claim 1 wherein a front edge on said apex of each said arch is beveled to slope from rear to front where said apex projects outwardly of a corresponding said cavity portion.

3. An electrical connector as set forth in claim 1 wherein a rear section on said housing defines an internal wall aligned with each said cavity portion and opposed to a planar interior bottom wall thereof, and is opposite said apex of a corresponding said contact, and said internal wall is sloped to face rearwardly for biasing a front edge on said apex of said arch toward said cavity bottom to position said contact section side walls beneath said cavity portion side walls.

4. An electrical connector as set forth in claim 3 wherein an interior wall of each said cavity defines a front facing shoulder forwardly of said internal sloped wall, and each said contact has a rear projecting tine latchable forwardly of said front facing shoulder upon full insertion of said contact in said cavity.

5. An electrical connector as set forth in claim 1 wherein a front lip of said housing projects in front of each said contact, each said cavity portion communicates with a corresponding groove in said front lip, and each said groove is aligned with said apex of a corresponding said contact in said cavity portion.

6. An electrical connector as set forth in claim 5 wherein selected ones of said cavity portions are farther from a front end of said housing than selected other ones thereof, and first portions of said front lip are longer in front of said selected ones of said cavity portions than second portions of said front lip in front of said selected other ones thereof.

7. An electrical connector as set forth in claim 6 wherein a front facing shoulder of said housing along each said cavity is equally spaced from said front lip with respect to said selected ones of said cavity portions and said selected others thereof, and said cavity portions are all equally wide, whereby said contact sections may be identically formed and include rear projecting tines latchable forwardly of respective said front facing shoulders, and said contacts may be mountable interchangeably in any of said selected ones and selected others of said cavity portions.

8. An electrical connector as set forth in claim 1 wherein a conductive shield encircles said housing and defines a mating connector receiving opening in a front end of said shield, and a passage extends along an interior of said shield spacing an interior shield surface away from said apex of each said contact.

9. An electrical connector as set forth in claim 8 wherein a rear section on said housing includes a front face having at least one tab receiving recess thereinto, and a respective tab on said shield extends into each said tab receiving recess to resist movement of said housing forwardly with respect to said shield.

* * * * *